US007040288B2

(12) United States Patent
Nakayama et al.

(10) Patent No.: US 7,040,288 B2
(45) Date of Patent: May 9, 2006

(54) FUEL INJECTION SYSTEM

(75) Inventors: Shinji Nakayama, Tokyo (JP); Susumu Kouketsu, Tokyo (JP); Keiki Tanabe, Tokyo (JP)

(73) Assignee: Mitsubishi Fuso Truck and Bus Corporation, Tokyo (JP)

( * ) Notice: Subject to any disclaimer, the term of this patent is extended or adjusted under 35 U.S.C. 154(b) by 0 days.

(21) Appl. No.: 11/094,476

(22) Filed: Mar. 31, 2005

(65) Prior Publication Data

US 2005/0229905 A1 Oct. 20, 2005

(30) Foreign Application Priority Data

Mar. 31, 2004 (JP) ..... 2004-106454

(51) Int. Cl.
*F02M 37/04* (2006.01)

(52) U.S. Cl. ..... 123/446; 123/447

(58) Field of Classification Search ..... 123/446, 123/447, 467, 496
See application file for complete search history.

(56) References Cited

U.S. PATENT DOCUMENTS 4,372,272 A 2/1983 Walter et al.
4,485,789 A 12/1984 Walter et al.
4,605,166 A * 8/1986 Kelly ..... 239/96
5,697,342 A 12/1997 Anderson et al.
5,738,075 A * 4/1998 Chen et al. ..... 123/446
5,743,237 A * 4/1998 Matta ..... 123/496
5,878,720 A * 3/1999 Anderson et al. ..... 123/496
6,453,875 B1 9/2002 Mahr et al.
6,845,754 B1 * 1/2005 Pecheny et al. ..... 123/446
6,910,462 B1 6/2005 Siun et al.
2005/0034709 A1 2/2005 Augustin

FOREIGN PATENT DOCUMENTS

JP 2002 539372 11/2002
WO WO 00/55495 9/2000

* cited by examiner

*Primary Examiner*—Thomas Moulis
(74) *Attorney, Agent, or Firm*—Jacobson Holman PLLC

(57) ABSTRACT

A booster unit is provided in an injector of a fuel injection system. The booster unit includes a booster piston accommodated in a pressure chamber, and a discharge valve capable of discharging fuel in a backpressure chamber. A needle valve drive unit includes a pressure-receiving piston and an open/close valve. A return passage is connected to a discharge side of the open/close valve. A fuel discharge passage in communication with the discharge valve is combined with the return passage in a confluence portion. A check valve is provided between the confluence portion and the open/close valve. A check valve permits the fuel discharged to the return passage from a pressurization chamber to be directed to the confluence portion, and prevents the fuel discharged to the fuel discharge passage from the backpressure chamber from being directed the open/close valve.

4 Claims, 3 Drawing Sheets

FUEL INJECTION SYSTEM

CROSS-REFERENCE TO RELATED APPLICATIONS

This application is based upon and claims the benefit of priority from prior Japanese Patent Application No. 2004-106454, filed Mar. 31, 2004, the entire contents of which are incorporated herein by reference.

BACKGROUND OF THE INVENTION

1. Field of the Invention

The invention relates to a fuel injection system having a booster unit for being used in an internal combustion engine, such as a diesel engine.

2. Description of the Related Art

A fuel injection system which uses a boost type common rail system in a diesel engine is generally known. In a fuel injection system of this type, fuel of a high flow rate and a high pressure is used as hydraulic fluid to move a booster piston. The booster piston is provided between a pressure chamber and a backpressure chamber in an injector. The booster piston is driven in accordance with a differential pressure occurring between the pressure chamber and the backpressure chamber when the fuel in the backpressure chamber is discharged. The fuel boosted by the booster piston is transferred to a needle valve mechanism in a nozzle portion of the injector.

A fuel injection system is described in a patent document (PCT National Publication No. 2002-539372), for example. This fuel injection system includes a needle valve drive unit which opens and closes a needle valve of the needle valve mechanism. The needle valve drive unit includes a pressurization chamber which introduces fuel fed from a common rail; an open/close valve capable of discharging the fuel in the pressurization chamber; and a pressure-receiving piston accommodated in the pressurization chamber. The needle valve drive unit opens the needle valve in conjunction with the discharge of the fuel preserved in the pressurization chamber.

In the fuel injection system described in the patent document, the booster piston is driven by the discharge of the fuel in the backpressure chamber of a booster unit. An injection operation (fuel injection) is executed in accordance with the discharge of the fuel in the pressurization chamber of the needle valve drive unit. The fuel discharged from the backpressure chamber of the booster unit is returned to a fuel tank through a fuel discharge passage provided for the booster unit. The fuel discharged from the pressurization chamber of the needle valve drive unit is returned to the fuel tank through a return passage independent of the fuel discharge passage.

Thus, the conventional system requires the fuel discharge passage for the booster unit and the return passage for the needle valve drive unit. These passages each extend to the fuel tank. Therefore, two systems of pipings are necessary, therefore making a complex piping configuration.

To make a simplified piping configuration, attempts have been made to combine the fuel discharge passage for the booster unit and the return passage for the needle valve drive unit together in a portion close to the injector. However, the flow rate being discharged from the backpressure chamber of the booster unit is greater than the flow rate being discharged from the pressurization chamber of the needle valve drive unit. Therefore, if the fuel discharge passage for the booster unit and return passage for the needle valve drive unit are combined together, a mutual interference occurs between a discharge flow stream from a discharge valve of the booster unit and a discharge flow stream from the open/close valve of the needle valve drive unit, whereby normal discharge is not done. It was discovered that this deteriorates injection characteristics of the injector.

BRIEF SUMMARY OF THE INVENTION

Accordingly, an object of the invention is to provide a fuel injection system which enables a piping configuration to be simplified without causing deterioration in injection characteristics of an injector.

A fuel injection system of the invention comprises a common rail which preserves a fuel pressurized; an injector having a booster unit which boosts the fuel supplied from the common rail thereby to transfer the fuel to a needle valve mechanism; and a needle valve drive unit to open or close a needle valve of the needle valve mechanism wherein the booster unit has a pressure chamber which introduces the fuel transferred from the common rail; a booster piston provided in the pressure chamber; a backpressure chamber which is separated by the booster piston from the pressure chamber and into which the fuel transferred from the common rail is introduced; a discharge valve which can discharge the fuel in the backpressure chamber; and a booster chamber which, when the fuel in the backpressure chamber is discharged, uses a portion that moves integrally with the booster piston thereby to boost the fuel and then transfers the fuel to the needle valve mechanism. The needle valve drive unit has a pressurization chamber which introduces the fuel transferred from the common rail; an open/close valve which can discharge the fuel in the pressurization chamber; and a pressure-receiving piston which is accommodated in the pressurization chamber and moves in a direction of opening the needle valve when the fuel in the pressurization chamber is discharged. The fuel injection system further comprises a return passage which provides communication between a discharge side of the open/close valve of the needle valve drive unit and a fuel tank; a fuel discharge passage which has one end connected to a discharge side of the discharge valve and the other end connected to a confluence portion in combination with the return passage and which can return the fuel in the backpressure chamber to the fuel tank; and a check valve provided between the confluence portion of the return passage and the open/close valve. The check valve permits the fuel discharged to the return passage from the pressurization chamber to be directed to the confluence portion, and prevents the fuel discharged to the fuel discharge passage from the backpressure chamber from being directed to the open/close valve.

According to the invention, the fuel discharge passage in communication with the backpressure chamber of the booster unit and the return passage in communication with the pressurization chamber of the needle valve drive unit ca be combined together in a portion close to the injector, thereby to enable a piping configuration to be simplified. Further, a mutual interference between a discharge flow stream from the backpressure chamber and a discharge flow stream from the pressurization chamber ca be prevented. Thereby, normal discharge of the fuel is performed, so that effects of not causing deterioration in injection characteristics of the injector ca be exhibited.

According to a preferable mode of the invention, the fuel discharge passage comprises an orifice which is provided between the confluence portion and the discharge valve and which imparts resistance to a flow of the fuel being directed to the confluence portion from the backpressure chamber. In the invention, the return passage may be connected to an intake side of a fuel pump which supplies the fuel to the common rail in a downstream side of the confluence portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
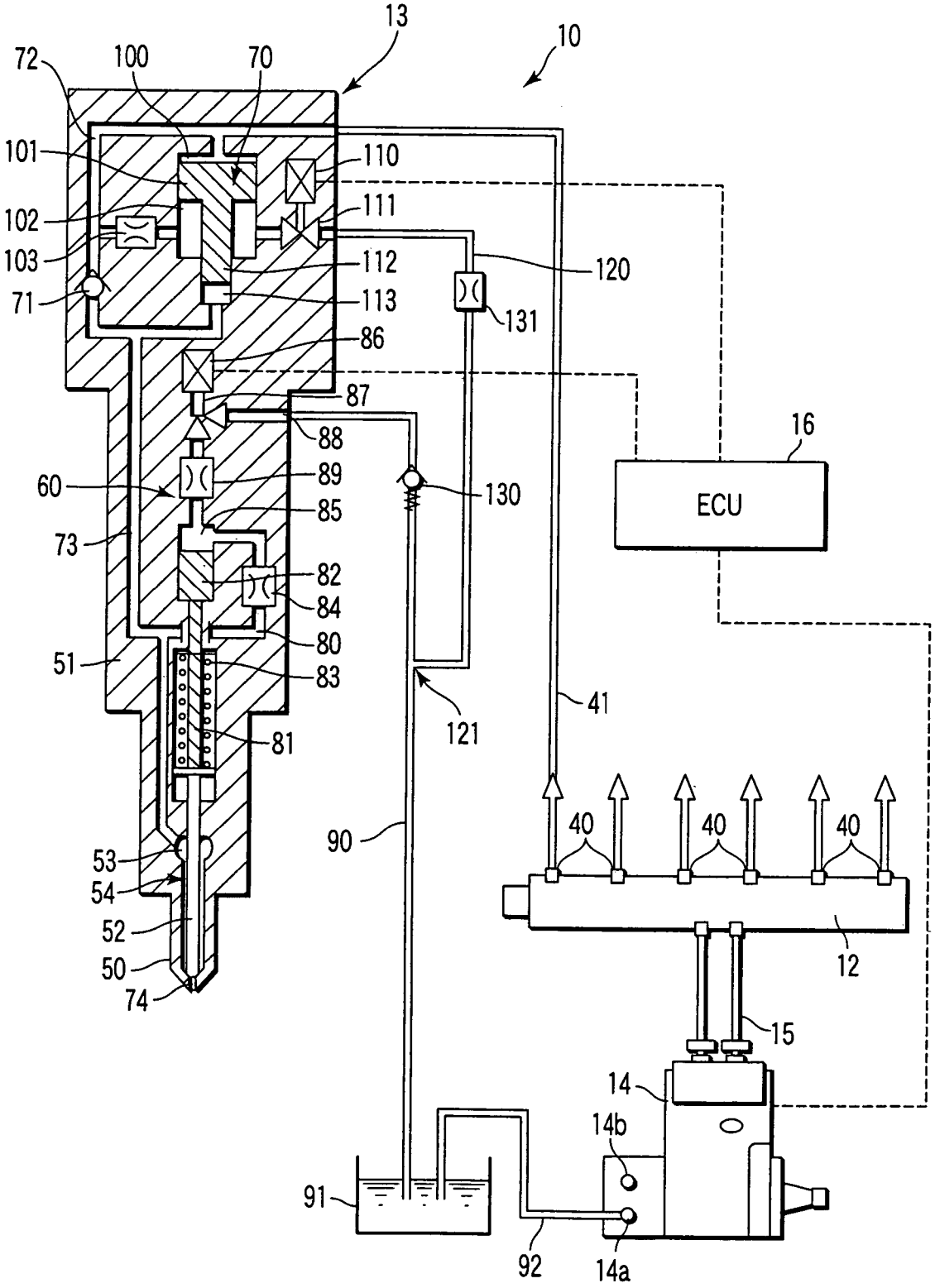
FIG. 1 is a cross sectional view showing a fuel injection system according to a first embodiment of the invention.
Figure 2:
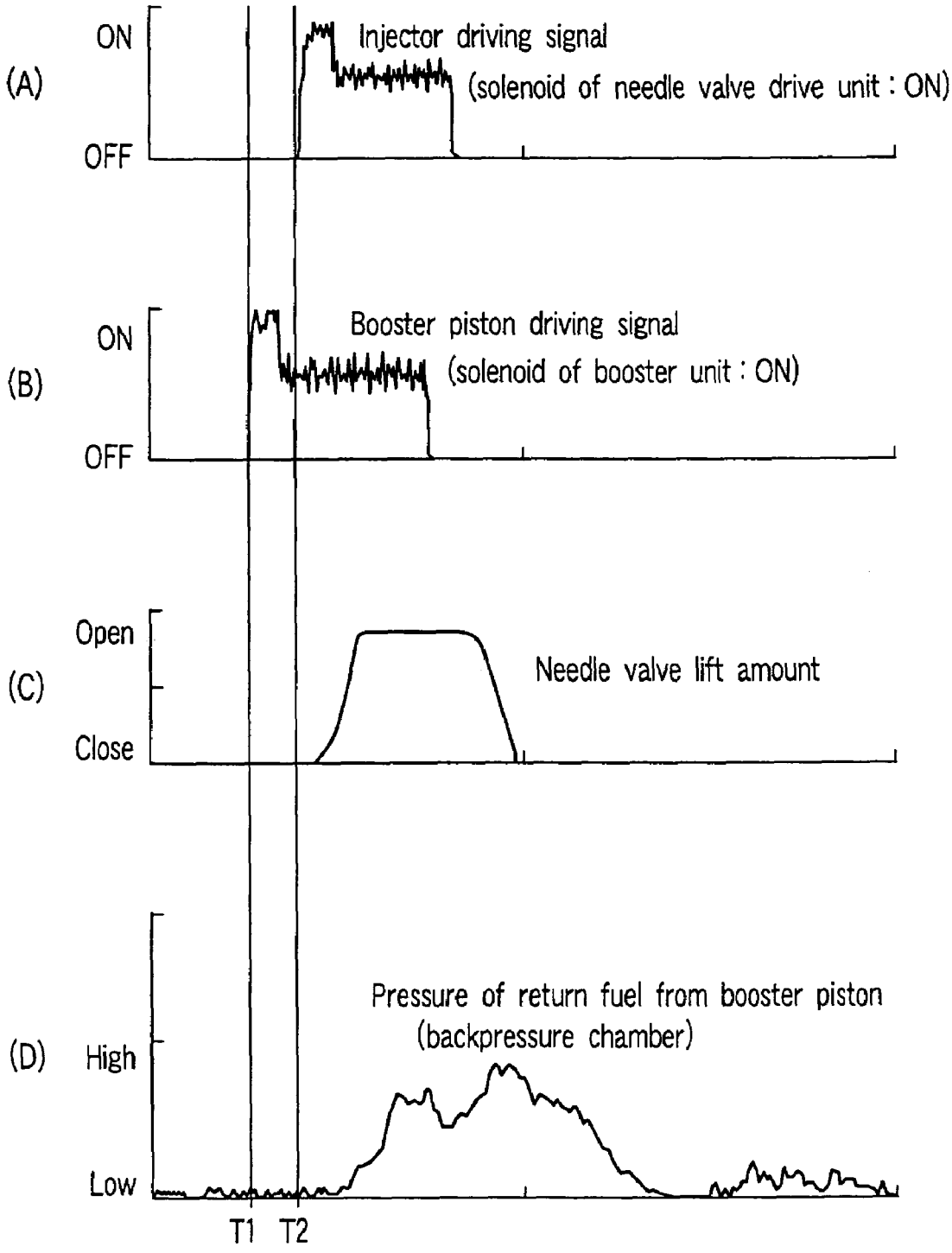
FIG. 2 shows diagrams illustrating driving signals for the fuel injection system shown in FIG. 1 and the relationship between a needle valve lift amount and a return fuel.

With reference to FIGS. 1 and 2, a first embodiment of the invention will be described hereinafter.

FIG. 1 shows a fuel injection system 10 which is used in a diesel engine that is exemplified for an engine. The fuel injection system 10 has at least members such as a common rail 12, an injector 13, and a fuel pump 14. The common rail 12 preserves pressurized fuel. The injector 13 is provided in each cylinder of the engine. The fuel pump 14 pressurizes fuel and feeds the pressurized fuel to the common rail 12. The common rail 12 and the fuel pump 14 are interconnected by a fuel feed pipe 15. The fuel pump 14 is controlled by a controller 16 for a discharge amount so that a fuel pressure in the common rail 12 becomes a fuel pressure of a desired value.

A plurality of discharge ports 40 is formed in the common rail 12. The discharge ports 40 feed the fuel to the injectors 13 of the cylinders, respectively. Only one of the injectors 13 is shown in FIG. 1. Practically, however, the injectors 13 of the cylinders are, respectively, connected to the discharge ports 40 of the common rail 12 through a fuel feed passage 41, wherein the fuel is fed to the respective injectors 13.

The respective injectors 13 include, for example, a body 51 having a nozzle portion 50, a needle valve mechanism 54, a needle valve drive unit 60, and a booster unit 70. The needle valve mechanism 54 includes a needle valve 52 provided in a portion close to the nozzle portion 50, and a fuel chamber 53. The needle valve drive unit 60 drives the needle valve 52 in the direction of opening/closing the needle valve 52. The booster unit 70 boosts the fuel fed from the common rail 12, thereby to feed the boosted fuel to the needle valve mechanism 54.

A fuel circulation portion 72 having a check valve 71 is formed in the injector 13. The fuel circulation portion 72 is connected to the common rail 12 through the fuel feed passage 41. The fuel fed from the common rail 12 is fed toward the fuel chamber 53 through the fuel circulation portion 72, the check valve 71, and a fuel circulation portion 73. The fuel circulation portion 73 is in communication with the nozzle portion 50. A fuel injection hole 74 is formed at the end of the nozzle portion 50.

The needle valve drive unit 60 includes, for example, a fuel passage 80, a pressure-receiving piston 82, a spring 83, a pressurization chamber 85, an open/close valve 87, a return fuel outlet 88, and an orifice 89. The fuel passage 80 is formed in the body 51. The pressure-receiving piston 82 has a drive shaft 81 which moves integrally with the needle valve 52 in the axial direction. The spring 83 urges the needle valve 52 in the closing direction. The pressurization chamber 85 is in communication with the fuel passage 80 through an orifice 84. The open/close valve 87 is driven by a solenoid 86. The return fuel outlet 88 is in communication with a discharge side of the open/close valve 87.

The return fuel outlet 88 is in communication with a fuel tank 91 through a return passage 90. The return passage 90 is in communication with a discharge side of the open/close valve 87 of the needle valve drive unit 60 and the fuel tank 91. The fuel tank 91 is in communication with an inlet 14*a* of the fuel pump 14 through a fuel feed pipe 92.

The booster unit 70 includes a pressure chamber 100, a booster piston 101, and a backpressure chamber 102. The pressure chamber 100 is in communication with the fuel feed passage 41. The booster piston 101 is accommodated in the pressure chamber 100. The backpressure chamber 102 is separated by the booster piston 101 from the pressure chamber 100. The backpressure chamber 102 is in communication with the fuel circulation portion 72 through an orifice 103. High pressure fuel fed from the common rail 12 through the fuel feed passage 41 is introduced into the pressure chamber 100 and the backpressure chamber 102.

The booster unit 70 further has a discharge valve 111, a plunger portion 112, and a booster chamber 113. The discharge valve 111 is opened by a solenoid 110 when the fuel preserved in the backpressure chamber 102 is discharged. The plunger portion 112 moves integrally with the booster piston 101 when the fuel in the backpressure chamber 102 is discharged. With the operation of the plunger portion 112, the booster chamber 113 pressurizes fuel.

The booster chamber 113 is in communication with the fuel circulation portion 73. One end of a fuel discharge passage 120 is connected to an outlet side of the discharge valve 111. The other end of the fuel discharge passage 120 is in combination with the return passage 90 in a confluence portion 121. The fuel in the backpressure chamber 102 is returned by the return passage 90 to the fuel tank 91.

A check valve 130 is provided between the confluence portion 121 of the return passage 90 and the open/close valve 87. The check valve 130 permits the fuel in the pressurization chamber 85 to flow through the open/close valve 87 toward the confluence portion 121. On the other hand, the check valve 130 prevents the fuel discharged to the fuel discharge passage 120 through the discharge valve 111 from the backpressure chamber 102 from flowing to the open/close valve 87.

An orifice 131 is provided in the fuel discharge passage 120. The orifice 131 is interposed between the confluence portion 121 and the discharge valve 111. The orifice 131 imparts resistance to the flow of the fuel toward the confluence portion 121 through the discharge valve 111 from the backpressure chamber 102.

The solenoid 86 of the open/close valve 87 and the solenoid 110 of the discharge valve 111 are individually controlled by the controller 16 for their opening/closing operation. The controller 16 is formed using an in-vehicle computer such as an ECU (electronic control unit), which is mounted in a vehicle, for example. When the injector 13 requires boost the controller 16 controls the solenoid 110 of the booster unit 70 to turn ON. In synchronization with the above or with a slight delay after the above, the controller 16 controls the solenoid 86 of the needle valve drive unit 60 to turn ON.

Operation of the fuel injection system 10 of the present embodiment will be described hereinafter with reference to FIGS. 1 and 2.

When the engine revolves (operates) and the fuel pump 14 is driven, fuel drawn into the fuel pump 14 from the fuel tank 91 is thereby pressurized. The pressurized fuel is then fed to the common rail 12. The pressure of fuel discharged from the fuel pump 14 is regulated by the controller 16 in correspondence to the operation mode of the engine. The fuel pressurized by the fuel pump 14 to a predetermined pressure is preserved in the common rail 12.

The fuel is injected into a combustion chamber of the respective cylinders of the engine from the fuel injection hole 74 of the corresponding injector 13. Corresponding to the operation mode of the engine, the injector 13 is driven in any one of a fuel boost mode (mode in which the booster unit 70 operates) and a fuel non-boost mode (mode in which the boost unit 70 does not operate). For example, the injector 13 operates in the fuel boost mode when the engine operates at high load. On the other hand, when the engine operates at low load, for example, during an idling of the engine, the injector 13 operates in a mode not requiring fuel boost.

With reference to (B) of FIG. 2, in the fuel boost mode, the solenoid 110 of the booster unit 70 is turned ON by a booster-piston driving signal at time T1. When the solenoid 110 is turned ON, the discharge valve 111 opens. Thereby, the booster piston 101 moves toward the booster chamber 113 in correspondence to a pressure-receiving area ratio between the booster piston 101 and the plunger portion 112. By this operation, the fuel in the backpressure chamber 102 is directed to travel through the discharge valve 111 to be discharged to the fuel discharge passage 120. Consequently, the fuel in the booster chamber 113 is boosted and transferred to the fuel circulation portion 73. The high pressure fuel discharged from the backpressure chamber 102 to the fuel discharge passage 120 is returned from the return passage 90 to the fuel tank 91 through the orifice 131 and the confluence portion 121.

Further, with reference to (A) of FIG. 2, the solenoid 86 of the needle valve drive unit 60 is turned ON by an injector driving signal at time T2. When the solenoid 86 is turned ON, the open/close valve 87 opens. Thereby, the fuel in the pressurization chamber 85 is discharged through the open/close valve 87 from the return fuel outlet 88 to the return passage 90. With this operation, the pressure-receiving piston 82 is moved in the direction opposite the needle valve 52, and the needle valve 52 is opened thereby, as shown in (C) of FIG. 2. Consequently, the fuel in the fuel chamber 53 is injected into the combustion chamber of the engine from the fuel injection hole 74. The fuel discharged from the pressurization chamber 85 to the return fuel outlet 88 causes the check valve 130 to open, travels through the confluence portion 121, and returns to the fuel tank 91 from the return passage 90. (D) of FIG. 2 shows the pressure of the return fuel.

Depending on the operation mode of the engine, the time T1 and the time T2 shown in FIG. 2 can possibly be substantially synchronous with each other. In this case, when the solenoid 110 of the booster unit 70 is turned ON, the solenoid 86 of the needle valve drive unit 60 is turned ON substantially at the same time, whereby the fuel injection is started. The rate of fuel injection is, therefore, lower in comparison to that in the fuel boost mode.

In the operation mode not requiring boost for the injector 13, the solenoid 110 of the booster unit 70 remains OFF. In this mode, the solenoid 86 of the needle valve drive unit 60 is turned ON, and the open/close valve 87 opens. Thereby, the fuel in the pressurization chamber 85 is discharged into the return passage 90 from the open/close valve 87, similarly as the case described hereinabove. Concurrently, the pressure-receiving piston 82 moves toward the needle valve 52, and the needle valve 52 opens. Upon opening of the needle valve 52, the fuel is injected from the fuel injection hole 74. In this case, the fuel is injected only at pressure being exerted by the common rail 12, so that the injection pressure is relatively low.

According to the fuel injection system 10 described above, the fuel discharge passage 120 and the return passage 90 ca be combined together in the confluence portion 121 close to the injector 13. The fuel discharge passage 120 is in communication with the discharge valve 111 of the booster unit 70. The return passage 90 is in communication with the open/close valve 87 of the needle valve drive unit 60. The fuel discharge passage 120 and the return passage 90 are combined together in the confluence portion 121 close to the injector 13. Accordingly, the piping configurations of the passages 90 and 120 ca be simplified.

In the event of the operation of the booster piston 101, fuel of a high pressure and a high flow rate is discharged to the fuel discharge passage 120. The check valve 130 is provided in the return passage 90. When the discharge valve 111 is opened, high pressure fuel is instantaneously discharged from the backpressure chamber 102. The check valve 130 prevents the high pressure fuel discharged from the backpressure chamber 102 from counter-flowing to the pressurization chamber 85. This consequently prevents backpressure from increasing to such an extent of inhibiting the injection operation of the injector 13. Further, the above can prevent a mutual interference between a discharge flow stream from the open/close valve 87 and a discharge flow stream from the discharge valve 111. Consequently, normal fuel discharge from the open/close valve 87 and the discharge valve 111 is performed, and injection characteristics of the injector 13 are not deteriorated.

Since the orifice 131 is provided in the fuel discharge passage 120, pulsations ca be restrained from occurring in, for example, portions close to the return passage 90 and the confluence portion 121. This enables the open/close valve 87 and the discharge valve 111 to perform even more normal fuel discharge.

Figure 3:
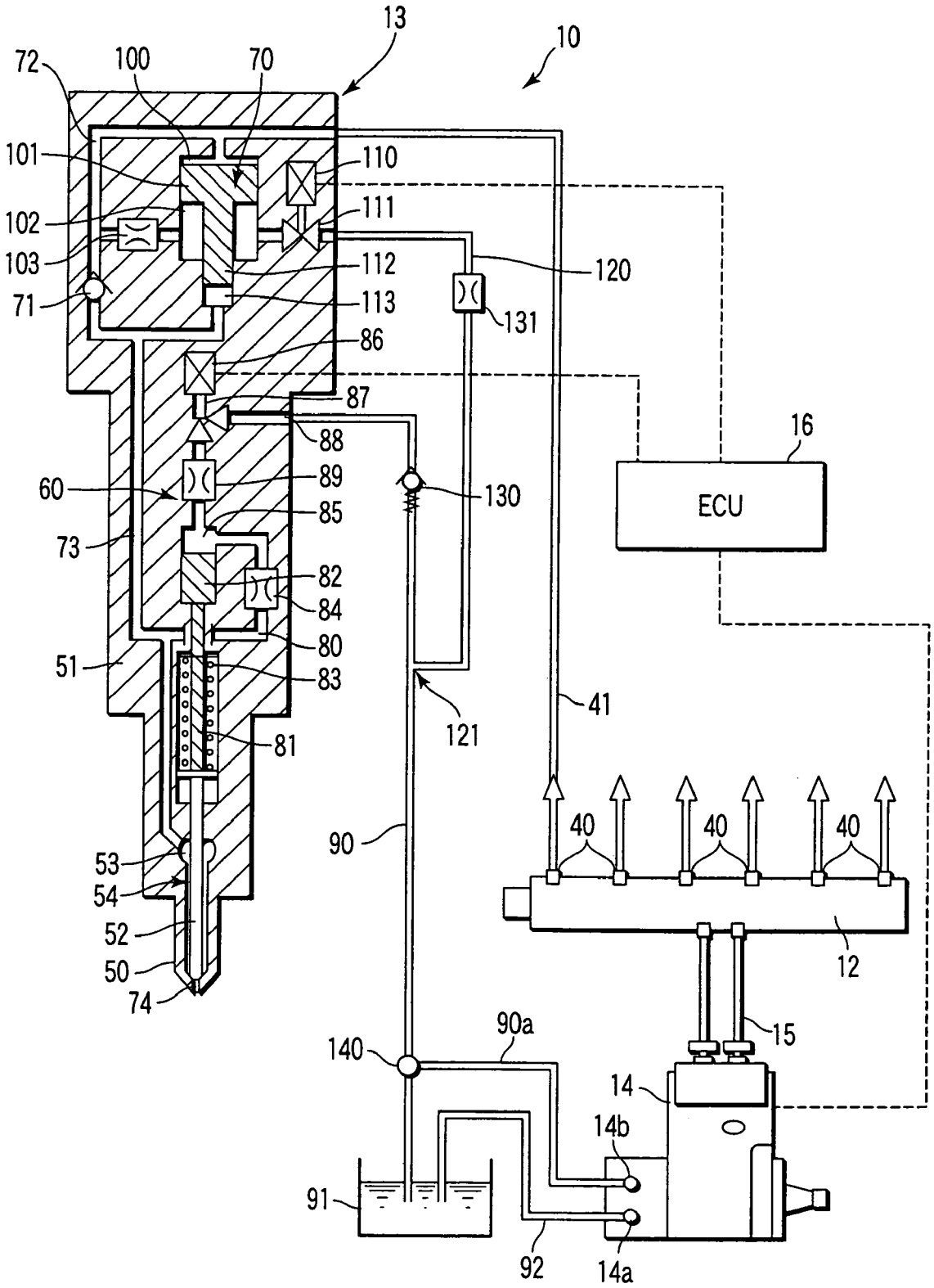
FIG. 3 is a cross sectional view showing a fuel injection system according to a second embodiment of the invention.

FIG. 3 shows a fuel injection system 10 according to a second embodiment of the invention. In a return passage 90 of the fuel injection system 10, a piping 90*a* on a downstream side of a confluence portion 121 is connected to an intake side 14*b* of a fuel pump 14 through a distribution portion 140. In the present embodiment, at least part of fuel being discharged from a pressurization chamber 85 and a backpressure chamber 102 ca be returned to the intake side 14*b* of the fuel pump 14. Therefore, part of functions of the fuel pump 14 ca be assisted. In this case, all the fuel being discharged from the pressurization chamber 85 and the backpressure chamber 102 might be returned to the intake side 14*b* of the fuel pump 14 through the piping 90*a*. Regarding the portions and operations other than those described hereinabove, the fuel injection system 10 of the second embodiment is the same as that of the first embodiment, so that the portions in the two embodiments are shown with the common numerals, and descriptions thereof will not be repeated here.

The invention may of course be practiced or carried out in various ways other than the above-described embodiments by appropriately modifying constitutional elements, such as injectors, fuel discharge passages, return passages, confluence portions, and fuel tanks without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fuel injection system comprising:

a common rail which preserves a fuel pressurized;

an injector having a booster unit which boosts the fuel supplied from the common rail thereby to transfer the fuel to a needle valve mechanism; and a needle valve drive unit to open or close a needle valve of the needle valve mechanism, wherein the booster unit comprises:

a pressure chamber which introduces the fuel transferred from the common rail;

a booster piston provided in the pressure chamber;

a backpressure chamber which is separated by the booster piston from the pressure chamber and into which the fuel transferred from the common rail is introduced;

a discharge valve which can discharge the fuel in the backpressure chamber; and a booster chamber which, when the fuel in the backpressure chamber is discharged, uses a portion that moves integrally with the booster piston thereby to boost the fuel and then transfers the fuel to the needle valve mechanism; and the needle valve drive unit has:

a pressurization chamber which introduces the fuel transferred from the common rail;

an open/close valve which can discharge the fuel in the pressurization chamber; and a pressure-receiving piston which is accommodated in the pressurization chamber and moves in a direction of opening the needle valve when the fuel in the pressurization chamber is discharged; and the fuel injection system further comprises:

a return passage which provides communication between a discharge side of the open/close valve of the needle valve drive unit and a fuel tank;

a fuel discharge passage which has one end connected to a discharge side of the discharge valve and the other end connected to a confluence portion in combination with the return passage and which can return the fuel in the backpressure chamber to the fuel tank; and a check valve provided between the confluence portion of the return passage and the open/close valve, wherein the check valve permits the fuel discharged to the return passage from the pressurization chamber to be directed to the confluence portion, and prevents the fuel discharged to the fuel discharge passage from the backpressure chamber from being directed to the open/close valve.

2. The fuel injection system according to claim 1, wherein the fuel discharge passage comprises an orifice which is provided between the confluence portion and the discharge valve and which imparts resistance to a flow of the fuel being directed to the confluence portion from the backpressure chamber.

3. The fuel injection system according to claim 1, wherein the return passage is connected to an intake side of a fuel pump which supplies the fuel to the common rail in a downstream side of the confluence portion.

4. The fuel injection system according to claim 2, wherein the return passage is connected to an intake side of a fuel pump which supplies the fuel to the common rail in a downstream side of the confluence portion.

* * * * *